US006911602B2

(12) United States Patent
Conrad

(10) Patent No.: US 6,911,602 B2
(45) Date of Patent: Jun. 28, 2005

(54) CONNECTING TERMINAL

(75) Inventor: Gerd Conrad, Mastbruchstrasse 213A, D-33104 Paderborn (DE)

(73) Assignees: Gerd Conrad, Paderborn (DE); Heinrich Hoelscher, Paderborn (DE)

( * ) Notice: Subject to any disclaimer, the term of this patent is extended or adjusted under 35 U.S.C. 154(b) by 62 days.

(21) Appl. No.: 10/650,052

(22) Filed: Aug. 26, 2003

(65) Prior Publication Data

US 2005/0029003 A1 Feb. 10, 2005

(30) Foreign Application Priority Data

Aug. 28, 2002 (DE) ..... 102 39 367
Nov. 19, 2002 (DE) ..... 102 53 861

(51) Int. Cl.[7] ..... H01R 4/28
(52) U.S. Cl. ..... 174/68.2; 439/441; 439/835
(58) Field of Search ..... 174/68.2, 70 B, 174/71 B, 72 B, 88 B, 99 B, 129 B, 133 B, 149 B; 439/435, 436, 438, 441, 832, 834, 835

(56) References Cited

U.S. PATENT DOCUMENTS 5,816,867 A * 10/1998 Davidsz et al. ..... 439/835
5,915,991 A * 6/1999 Roman ..... 439/441
6,074,242 A * 6/2000 Stefaniu et al. ..... 439/441
6,280,233 B1 * 8/2001 Beege et al. ..... 439/441
6,350,162 B1 * 2/2002 Despang ..... 439/835
6,428,343 B1 * 8/2002 Landis et al. ..... 439/441
6,464,545 B2 * 10/2002 Yano ..... 439/441
6,682,364 B2 * 1/2004 Cisey ..... 439/441
6,796,855 B2 * 9/2004 Fricke et al. ..... 439/835

FOREIGN PATENT DOCUMENTS

DE 27 24 354 A1 11/1978
DE 42 31 244 A1 3/1994
DE 195 47 557 A1 6/1997
DE 100 53 035 A1 5/2002

* cited by examiner

*Primary Examiner*—Anthony Dinkins
*Assistant Examiner*—Adolfo Nino
(74) *Attorney, Agent, or Firm*—Laurence A. Greenberg; Werner H. Stemer; Ralph E. Locher

(57) ABSTRACT

A connecting terminal, in particular a terminal strip, has a busbar and at least one spring terminal element. The spring terminal element is formed separately from the busbar, it is electrically conductively connected to it, and it is as thin as possible, with minimum use of material. The spring element has a spring limb and a contact limb opposite the spring limb, for connecting an electrical conductor which has been inserted between these limbs and rests against the contact limb. The spring limb and the contact limb are both supported against the busbar for absorbing spring forces.

35 Claims, 8 Drawing Sheets

CONNECTING TERMINAL

BACKGROUND OF THE INVENTION

Field of the Invention

The invention pertains to a connecting terminal. A first aspect of the invention relates to a connecting terminal, in particular a terminal strip, having a busbar and at least one spring terminal element which is formed separately therefrom, is electrically conductively connected thereto and is suitable for fitting a conductor without the use of screws by a conductor end being pushed in with a force that overcomes the resistance of the spring force of the spring terminal element (or into the spring terminal element which is opened by an auxiliary tool) and sufficient contact being made with it owing to the spring force. Connecting terminals of this type are particularly customary in domestic electrical installation practice and lead to considerable savings in the time spent on fitting the conductor owing to the lack of screws.

A connecting terminal of the foregoing type is known, for example, from German published patent application DE 27 24 354, in which a leaf spring having one central and two opposing bent portions which are curved in opposing directions is inserted in holders for a busbar, the bent portions each having free limbs which are oriented obliquely with respect to the contact regions of the busbar and rest against it with spring force. A disadvantage of the prior art design is the fact that, owing to the fact that the leaf spring, viewed in the direction of arrangement, is in front of the busbar, the thickness of the connecting terminal when viewed in the direction of arrangement is always greater than the thickness of the leaf spring which, in turn, must be at least as large as the largest wire diameter to be accommodated.

A leaf spring terminal is known from German published patent application DE 100 53 035. That leaf spring terminal has a support block comprising a profiled brass strip to which a leaf spring is connected. This has the disadvantage that the support block has a considerable material cross section which in practice results in corresponding material costs.

An electrical connecting terminal having a spring force terminal element is known from German published patent application DE 42 31 244 which, with regard to the minimum width to be achieved in the direction of arrangement, is equally as disadvantageous as the terminal known from the above-mentioned DE 27 24 354 since, in this case too, a spring limb clamping a conductor which has been introduced is, viewed in the direction of arrangement, in front of the regions of a busbar which form a connecting chamber for the conductor, as a result of which the thickness of the connecting terminal in the direction of arrangement is necessarily greater than the thickness of the spring limb.

Finally, an electrical terminal having spring force terminal elements is known from German published patent application DE 195 47 557, in which the spring force terminal elements are bent in one part from spring steel and a spring end section passes through an opening, for accommodating a conductor, in a fixing end section of the spring force terminal element. With this design, the spring force terminal element has to be opened in a separate method step before the conductor can be inserted, i.e. the conductor cannot be fitted simply by applying pressure.

SUMMARY OF THE INVENTION

It is accordingly an object of the invention to provide an electrical connector, which overcomes the above-mentioned disadvantages of the heretofore-known devices and methods of this general type and which improves a generic connecting terminal to the extent that, with minimum use of material, it is as thin as possible.

With the foregoing and other objects in view there is provided, in accordance with the invention, a connecting terminal, comprising:

a busbar;

at least one spring terminal element formed separately of the busbar and electrically conductively connected to the busbar;

the spring terminal element having a spring limb and a contact limb opposite the spring limb for connecting an electrical conductor to be inserted between the spring limb and the contact limb and to rest against the contact limb; and the spring limb and the contact limb each being supported against the busbar for absorbing spring forces.

In other words, the objects are achieved for a generic connecting terminal by the features according to the invention in that the spring terminal element has a spring limb and a contact limb opposite the spring limb for connecting an electrical conductor which has been inserted between these limbs and rests against the contact limb. The spring and contact limbs each are supported against the busbar for absorbing spring forces.

In a preferred refinement of the invention, provision is made for the spring and contact limbs to be formed in one or more parts from bent, flat material which has essentially only bending radii which lie in a plane which is oriented perpendicular to a width direction of the flat material, with the result that a width dimension of the spring terminal element essentially corresponds to the width of the flat material.

This embodiment results, when used as a terminal strip, in the thickness of the connecting terminal (dimension in the direction of arrangement) being no greater than the width dimension of the flat material from which the spring terminal element (spring and contact limbs) is formed (plus the thickness of the insulating material of the enclosure), with the result that the width of the connecting terminal is considerably smaller, in relation to the maximum conductor diameter that can be accommodated, than with known embodiments.

The invention expediently provides for the spring terminal element to be formed in two parts and for the spring limb to be composed of a material having a high modulus of elasticity, in particular spring steel.

The invention further provides for the spring terminal element to be formed in two parts and for the contact limb to be composed of a highly conductive material, in particular a copper alloy.

The spring and contact limbs may in each case be essentially U-shaped or V-shaped and be connected to one another along in each case one subregion.

The contact limb may have fluting in order to improve the contact with and fixing of a conductor.

The invention preferably provides for the contact limb to have an opening in the form of a slot for connecting, in particular riveting, it to a corresponding projection on the busbar.

As long as a two-part design of the spring terminal element is selected, the spring and contact limbs can be riveted, welded or otherwise connected to one another. No conductive connection is necessary since only the contact limb is required to produce a conductive connection.

A particularly expedient embodiment provides for the spring terminal element to have an additional spring section which exerts an additional spring force on the spring limb when the deflection exceeds a predetermined amount. The additional spring section may be in the form of an extension of the spring limb.

A first embodiment of the invention provides for the busbar to be produced, in particular stamped, from a planar, flat material and oriented perpendicular to a width direction of the spring terminal element.

In this case, provision is preferably made for the busbar to have (in each case) one accommodating recess for the (each) spring terminal element.

The (or, each) accommodating recess may be U-shaped having a base section and two side sections, the spring terminal element being fixed to the base section, in particular by riveting, welding and/or soldering. Alternatively, provision may be made for the spring terminal element to be retained in its accommodating recess in an interlocking manner, for example simply by being pushed in.

Provision is expediently made for a rivet projection, which engages in the opening in the form of a slot in the spring terminal element, to be formed in the region of the base section of the (or, each) accommodating recess.

The invention further provides for the busbar to have spring contacts for accommodating at least one link finger.

The spring contacts may be formed, by stamping, integrally with the busbar.

Provision may further be made for a protective conductor connection to be formed integrally with the busbar.

A second embodiment of the invention provides for the busbar to be produced in the form of a strip from a planar, flat material having a width which essentially corresponds to the width of the spring terminal element.

Provision is preferably made for the busbar to be essentially planar.

The spring terminal element is expediently provided with support attachments by means of which it is supported against the busbar. Here, provision is preferably also made for the contact limb to be U-shaped in a central region and to merge at both end sections with reversely U-shaped support attachments, free ends of the support attachments being connected to the busbar, in particular by riveting or latching.

Provision is further made for the free ends of the support attachments to engage in a resilient manner in stamped openings in the busbar.

The invention further provides for the support attachments to extend inclined with respect to the busbar in order to improve the supporting effect.

With the above and other objects in view there is also provided, in accordance with the invention, a connecting terminal, in particular a terminal strip, having a busbar, which is produced from a planar, flat material, and having at least one spring terminal element, which is formed separately from the busbar, is retained on it and has a spring limb for connecting an electrical conductor, the spring terminal element being formed from a bent spring material in the form of a strip which has essentially only bending radii which lie in a plane which is oriented perpendicular to its width direction, with the result that a width dimension of the spring terminal element essentially corresponds to the width of the spring material.

A connecting terminal of this type is known, for example, from the above-mentioned patent application DE 27 24 354.

The object on which the invention is based is achieved with a connecting terminal of this type by the busbar being oriented perpendicular to the width direction of the spring terminal element and the spring terminal element being supported against the busbar for absorbing spring forces.

Provision is preferably made for a contact face, against which the spring limb of the spring terminal element presses an electrical conductor, to be formed by a region of the planar, flat material which is angled perpendicular to a plane of extent of the busbar.

Provision may be made for the spring terminal element and the busbar to be riveted, welded or otherwise connected to one another. An electrical contact is not absolutely necessary in this case.

Provision may further be made for the busbar to have a stop, formed integrally with it, against which the spring limb rests to an increasing extent as the deflection increases.

Provision is expediently made for the busbar to have (in each case) one accommodating recess for the (each) spring terminal element.

Provision may also be made for a protective conductor connection to be formed integrally with the busbar.

Other features which are considered as characteristic for the invention are set forth in the appended claims.

Although the invention is illustrated and described herein as embodied in a connecting terminal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
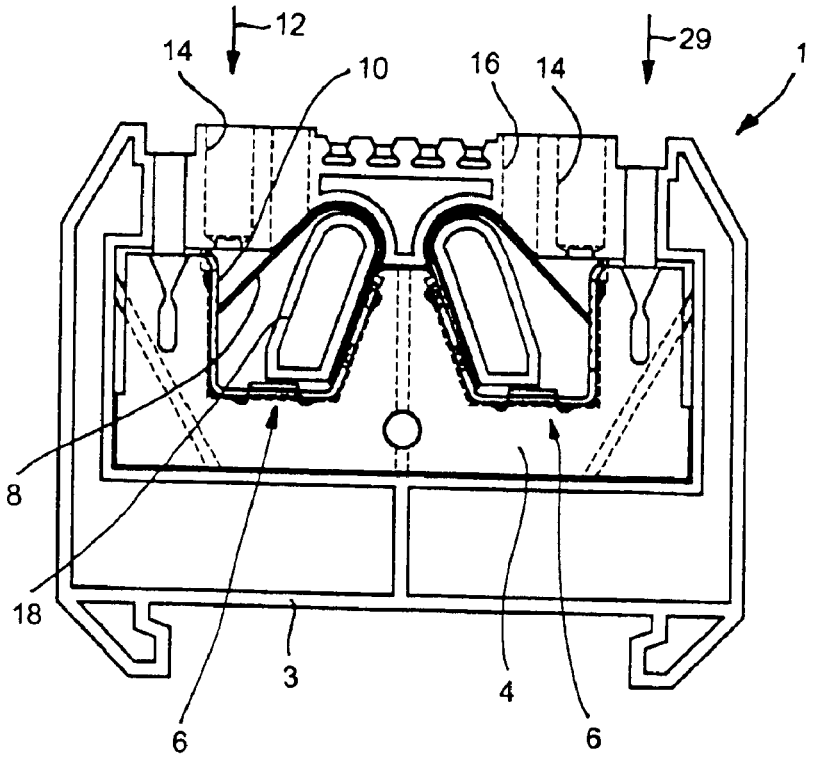
FIG. 1 is a side view of a first embodiment of a connecting terminal according to the invention in the form of a terminal strip.
Figure 2:
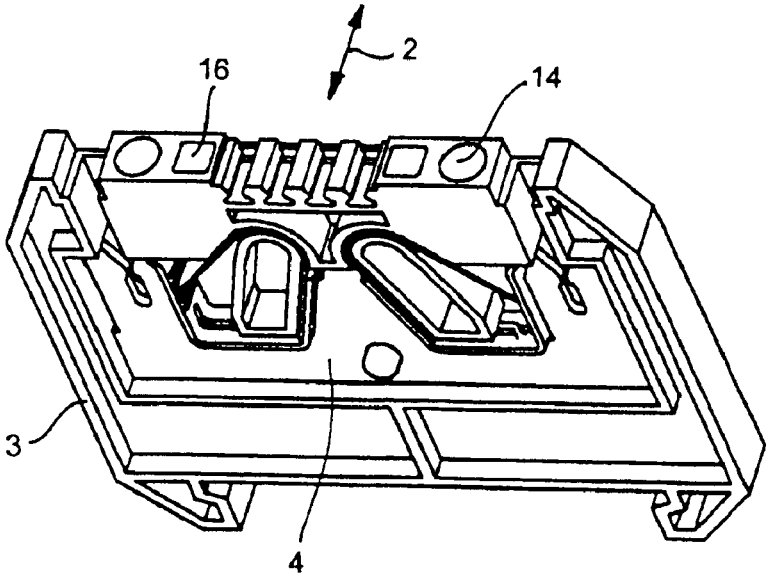
FIG. 2 is a perspective illustration of the terminal strip shown in FIG. 1.

Referring now to the figures of the drawing in detail and first, particularly, to FIGS. 1–9 thereof, there is shown a first embodiment of a connecting terminal according to the invention in the form of a terminal strip 1 of which a side and a perspective view are shown in FIGS. 1 and 2. The terminal strip 1 has, in a manner known per se, an insulating plastic enclosure 3 which is relatively narrow in the direction of arrangement and serves the purpose of retaining a busbar 4 in an insulating manner. Two spring terminal elements 6, which each have a spring limb 8 and a contact limb 10 and are conductively connected to the busbar 4, are firmly connected to the busbar.

Conductors to be connected can be fitted in a time-saving manner using the plug-in technique by being inserted through an enclosure opening 14 in the direction of the arrow 12 and between the spring limb 8 and the contact limb 10, the spring limb 8 being opened away from the contact limb 10 such that a contact end section of the conductor to be connected is retained by clamping between the spring and contact limbs. In order to release the conductor, a suitable aid, for example a screwdriver, can be inserted through a further enclosure opening 16 and the spring limb 8 can be opened. A stop 18 is provided in order to prevent the spring limb bending back too far.

Figure 4:
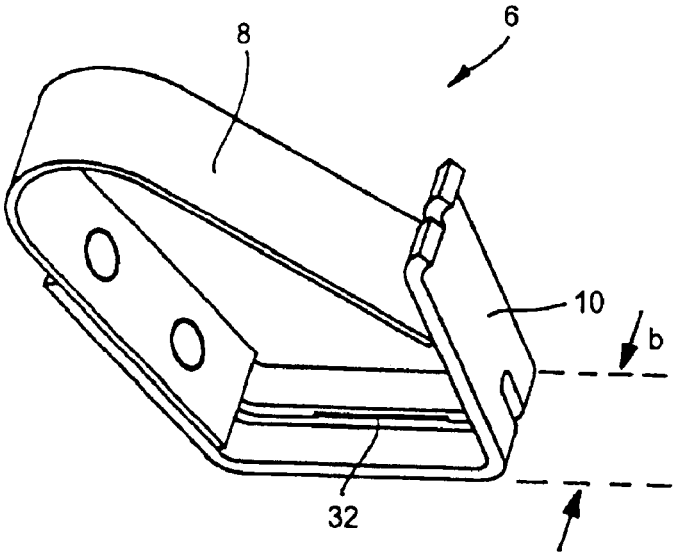
FIG. 4 is an enlarged perspective illustration of a spring terminal element according to the invention.
Figure 5:
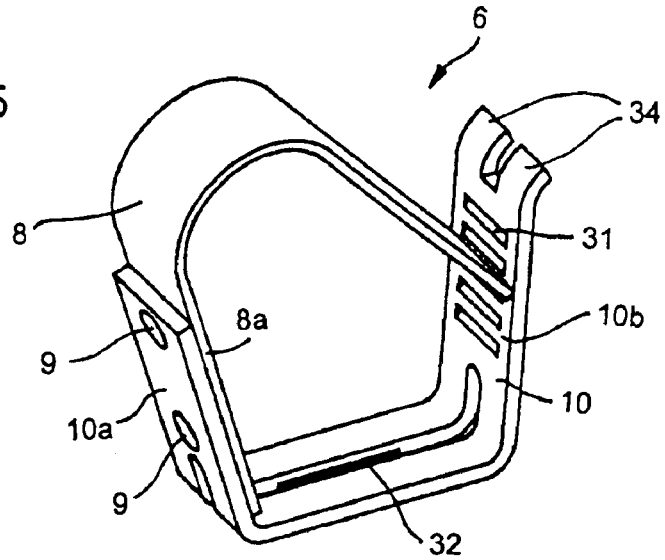
FIG. 5 is a further perspective illustration of the spring terminal element shown in FIG. 4.
Figure 6:
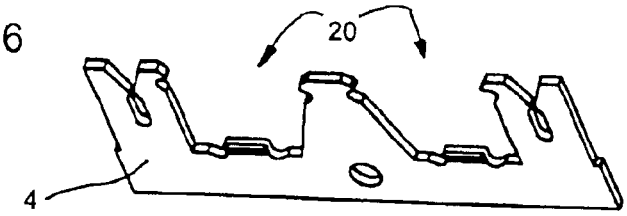
FIG. 6 is a perspective illustration of the busbar for the connecting terminal shown in FIGS. 1 to 3.
Figure 7:
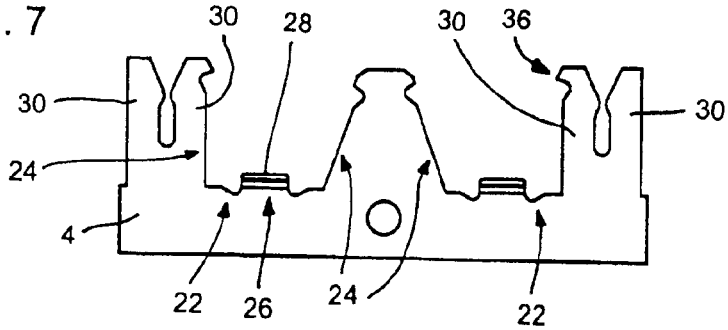
FIG. 7 is a side view of the busbar shown in FIG. 6.

FIGS. 3 to 7 serve the purpose of explaining the busbar and spring terminal elements retained in the enclosure 3. As shown in FIGS. 6 and 7, the busbar 4 is produced by stamping from a planar, flat material, in particular from galvanized sheet copper, and has two U-shaped accommodating recesses 20 for in each case one spring terminal element 6, each accommodating recess having a base section 22 and two side sections 24 which are oriented essentially perpendicular to said base section. In the region of each base section 22 a rivet projection 26 is formed, whose free end has a sloping part 28.

Laterally adjacent to each of the accommodating recesses 20, two spring contacts 30, which serve the purpose of accommodating in each case one link finger which can be inserted in the direction of the arrow 29 (FIG. 1), are formed by stamped-out parts which narrow and then widen.

FIGS. 4 and 5 explain the design of the spring terminal elements 6. Although the spring terminal elements could be in one part, in the embodiment illustrated, in order to improve their operation, the materials are chosen with regard to resilience and conductivity, each spring terminal element 6 being formed in two parts from a spring limb 8 composed of spring steel and an essentially U-shaped contact limb 10 which are connected to one another by riveting 9 in the region of a subsection 8*a*, 10*a*. The contact limb 10 is provided, in the region of a contact face 10*b*, with fluting 31 which serves the purpose, on the one hand, of improving the contact and, on the other hand, of improving the mechanical retention of a conductor which has been inserted.

The contact limb 10 also has an opening 32 in the form of a slot for placing on a rivet or clamping projection 26 on the busbar. Two attachments 34 in the form of forks engage on both sides over a projection 36 on the busbar 4 in order to prevent the contact limb 10 from moving in the transverse direction.

Figure 3:
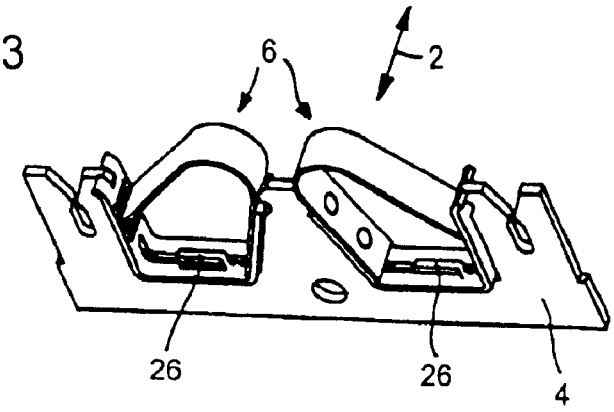
FIG. 3 is a perspective view of the connecting terminal shown in FIG. 2, an outer plastic enclosure being omitted.

It can be seen clearly from FIGS. 1 to 3 that the spring terminal element is supported on one side by the spring limb 8 and on the other side by the contact limb 10 against the side sections 24 of the busbar 4 and thus, even when the spring limb 8 produces a relatively large spring force, no bending stress need be absorbed in the region of the contact limb 10, since the spring force is completely absorbed by the busbar. The contact bar 10 therefore only needs to be designed for the current intensities occurring, not for the spring forces, which results in considerable savings on materials. A further advantage is that the width of the connecting terminal (FIG. 3) corresponds, in the direction of arrangement 2, with the width b (FIG. 4) of the spring terminal element, i.e. of the contact limb 10 and the spring limb 8, which is in turn a consequence of the physical design, which does not require any bent-back reinforcement regions on the spring and contact limbs.

In order to improve the contact between the spring terminal elements and the busbar, the rivet and clamping projections 26 are shaped, once the spring terminal element has been placed on top, such that the spring terminal elements are firmly and undetachably connected to the busbar. Alternatively or in addition, a connection may be made by soldering or welding.

Figure 15:
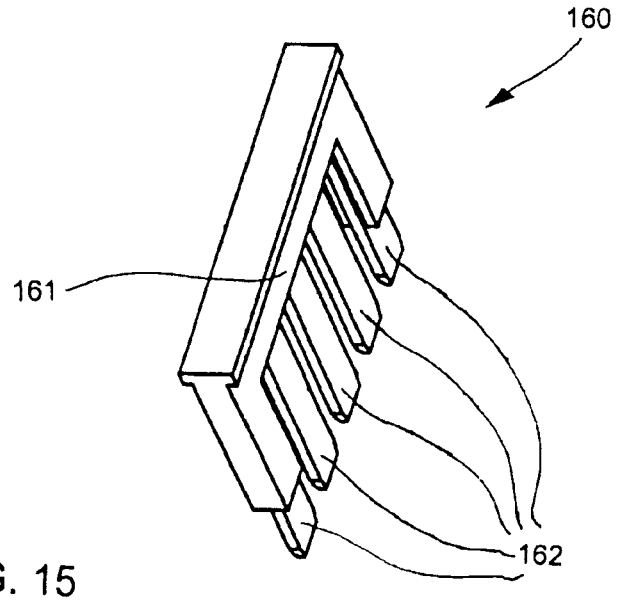
FIGS. 15 and 16 show two views of a link for use with the first embodiment of the connecting terminal.
Figure 16:
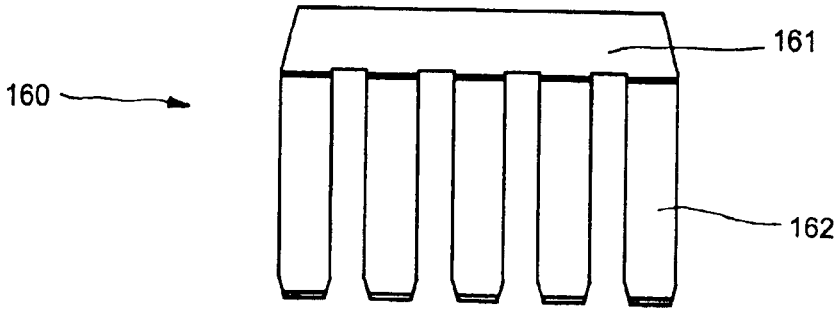
Figure 17:
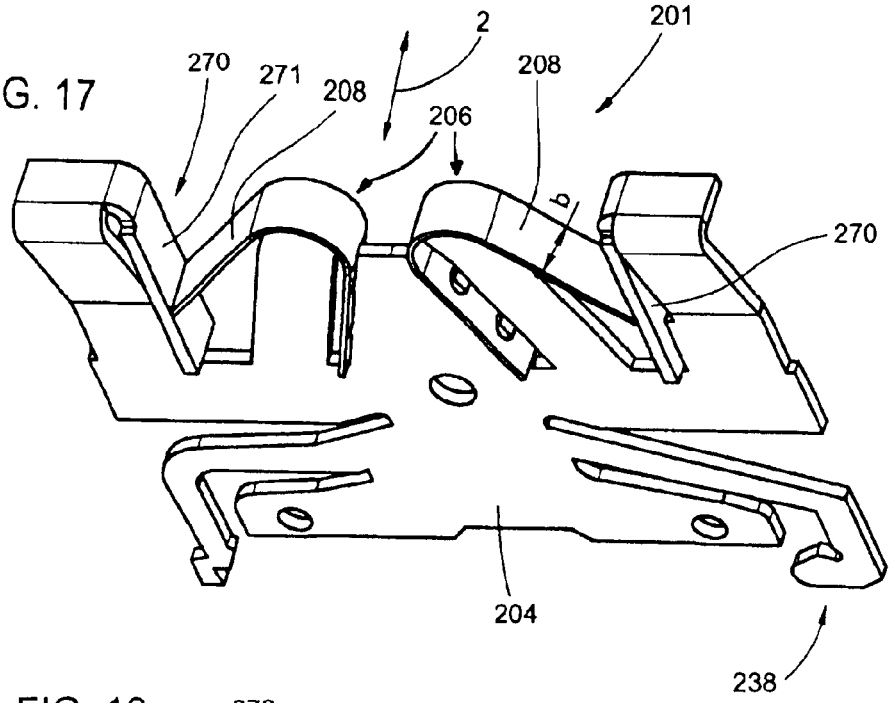
FIG. 17 is a perspective view of a further embodiment of the connecting terminal according to the invention in the form of a terminal strip.
Figure 18:
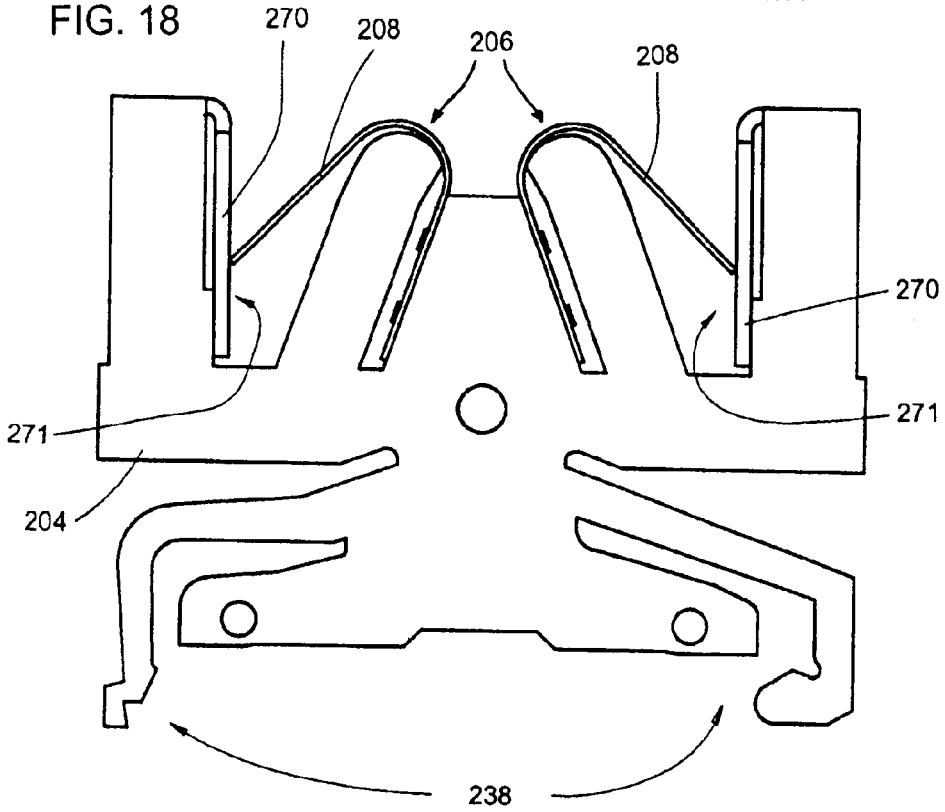
FIG. 18 is a side view of the embodiment shown in FIG. 17.

A further advantage of the connecting terminal according to the invention shown in FIGS. 1 to 7 is that link connections can be produced in a very simple manner by spring contacts 30, which serve the purpose of accommodating the comb-like link fingers which can in turn be produced in a very cost-effective manner, being stamped out such that they are integral with the busbar. FIGS. 15 and 16 show, by way of explanation, a link 160 having a web 161, from which five link fingers 162 originate, of a type which is known per se.

Figure 8:
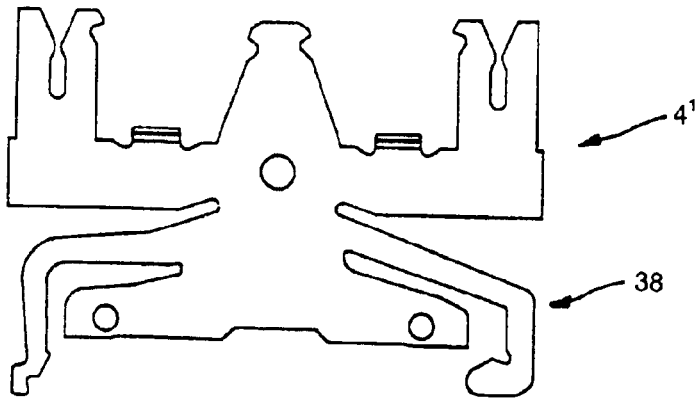
FIG. 8 is a side view of a variant of the busbar shown in FIGS. 6 and 7 which is provided with a protective conductor connection.
Figure 9:
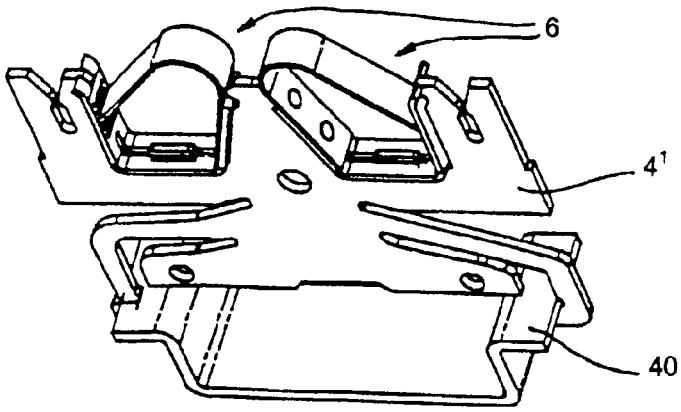
FIG. 9 is an explanatory illustration which shows a connecting terminal having a busbar shown in FIG. 8 which is latched onto a protective conductor bar.

FIGS. 8 and 9 explain a variant of a busbar 4' according to the invention, which serves the purpose of latching onto a protective conductor bar 40 by means of a protective conductor connection 38, whilst the busbar 4' otherwise corresponds to the busbar 4.

Figure 10:
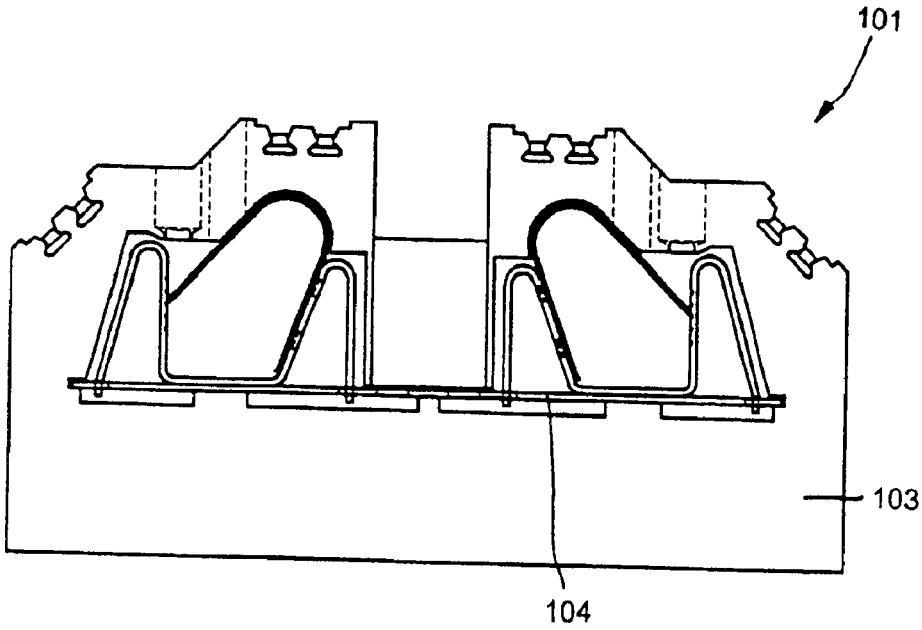
FIG. 10 is a side view of a further embodiment of the connecting terminal according to the invention in the form of a terminal strip.
Figure 11:
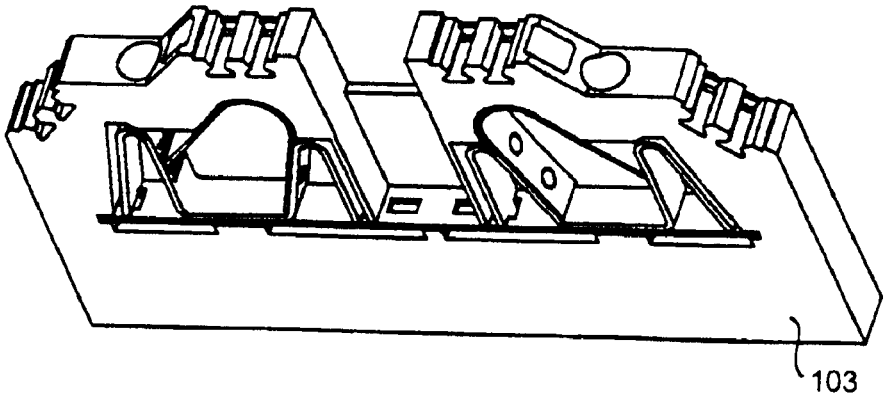
FIG. 11 is a perspective view of the terminal strip shown in FIG. 10.

FIGS. 10 to 14 show a further embodiment of a connecting terminal according to the invention, FIGS. 10 and 11 showing a side and perspective view, corresponding to FIGS. 1 and 2, of a terminal strip 101 having an insulating plastic enclosure 103, a busbar 104 and spring terminal elements 106. With regard to the use and the operation of the terminal strip 101, reference is made to the explanations for FIGS. 1 and 2 in this regard.

Figure 13:
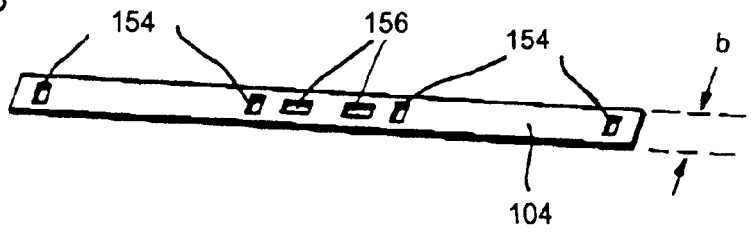
FIG. 13 is a perspective view of a busbar in a connecting terminal shown in FIGS. 10 and 11.
Figure 14:
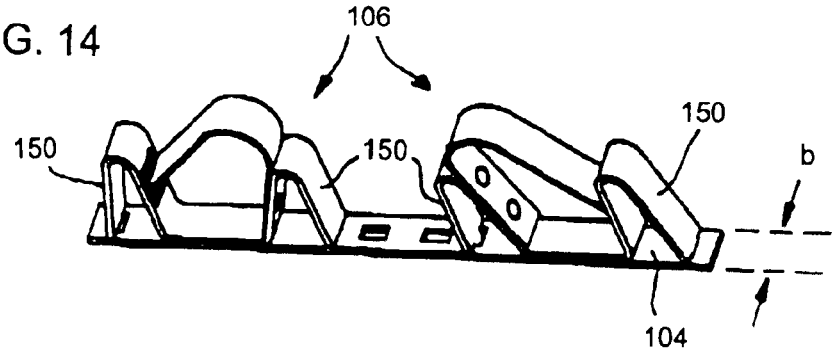
FIG. 14 is a perspective view of the connecting terminal shown in FIGS. 10 and 11, a plastic enclosure being omitted.

The busbar 104 of the terminal strip 101 shown in FIG. 13 is produced in the form of a strip from a planar, flat material, in particular from a galvanized copper alloy having a width which, in contrast to the embodiment shown in FIGS. 1 to 9, corresponds essentially to the width/thickness b of the spring terminal elements 6, as shown in FIG. 14.

Figure 12:
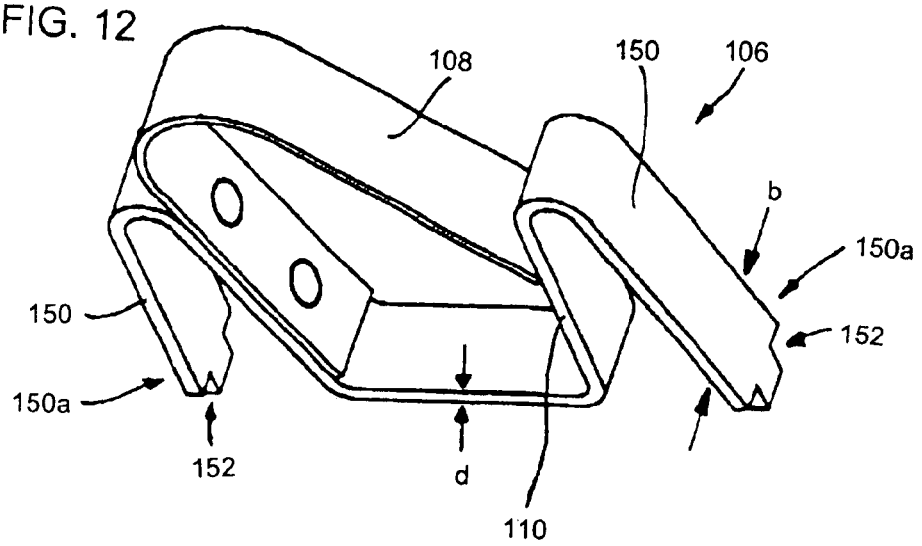
FIG. 12 is an alternative embodiment of a spring terminal element according to the invention in the connecting terminal shown in FIGS. 10 and 11.

FIG. 12 shows an enlarged illustration of a spring terminal element 106, in which it can be seen that a central section of the spring terminal element having a spring limb 108 corresponds to the spring terminal element 6 of the first exemplary embodiment, whilst the spring terminal element 106 is additionally provided with support attachments 150 by means of which it is supported in relation to the busbar 104. Free ends 150*a* of the support attachments 150 have stamped-out parts 152 in order for it to be possible for the support attachments to be inserted into corresponding openings 154 in the busbar 104 in a resilient manner. In order to improve the contact and mechanical attachment, the free ends 150*a* may be riveted or shaped in the region of the stamped-out parts 152 once inserted into the openings 154, a captive connection being produced. Here too, alternatively or in addition, a soldered or welded connection is possible.

The busbar 104 also has link openings 156 for accommodating link fingers.

The major advantages of the embodiment described above as compared with the prior art are that the material of the spring terminal element 106 (more precisely the contact limb 110) including the support attachments 150 can be produced from a relatively thin material having a cross section which depends on the current density to be expected, whilst the mechanical stiffness of the spring terminal element is maintained by the support against the busbar 104. In addition, the connecting terminal has a minimal width b in the direction of arrangement since all of the components are formed from a flat material which extends in the width direction without regions being required which are bent back in the transverse direction, serve the purpose of increasing the mechanical stiffness and would enlarge the width of the connecting terminal by the amount of the material thickness d (FIG. 12).

FIGS. 17 to 21 explain a further embodiment of a connecting terminal according to the invention in the form of a terminal strip 201 having a busbar 204 and spring terminal elements 206, reference being made to the explanations for FIGS. 1 to 9 with regard to the use and operation of the terminal strip 201.

In contrast to the first embodiment, the busbar 204 for the terminal strip 201 is not completely planar but has two regions 270 which are angled perpendicular to a plane of extent of the busbar and which form contact faces 271 which serve the purpose of making contact with a conductor which has been pushed in between said contact faces and a spring limb 208 of the spring terminal element 206. The operation of the spring terminal element 206 thus corresponds to that of the spring terminal element 6 in the first embodiment except that the spring terminal element 206 is formed in one part in the form of a U- or C-shaped spring and does not require a separate contact limb, since this is formed by the busbar 204.

As FIGS. 17 to 21 further show, a stop 218, corresponding to the stop 18 in the first embodiment, is produced integrally with the busbar 204 from sheet metal, which results in further advantages with regard to both the production and operation. Firstly, production as one part is more cost-effective and, secondly, it is possible, owing to the fact that the stop is not made of plastic but of metal, for the spring constant (spring hardness) of the spring terminal element 206 to be considerably increased, if necessary, since the spring limb 208 rests increasingly on the curved stop face the more it bends in the direction of the stop 218, with the result that the effective length of the limb is shortened and thus the spring effect is increased.

Figure 19:
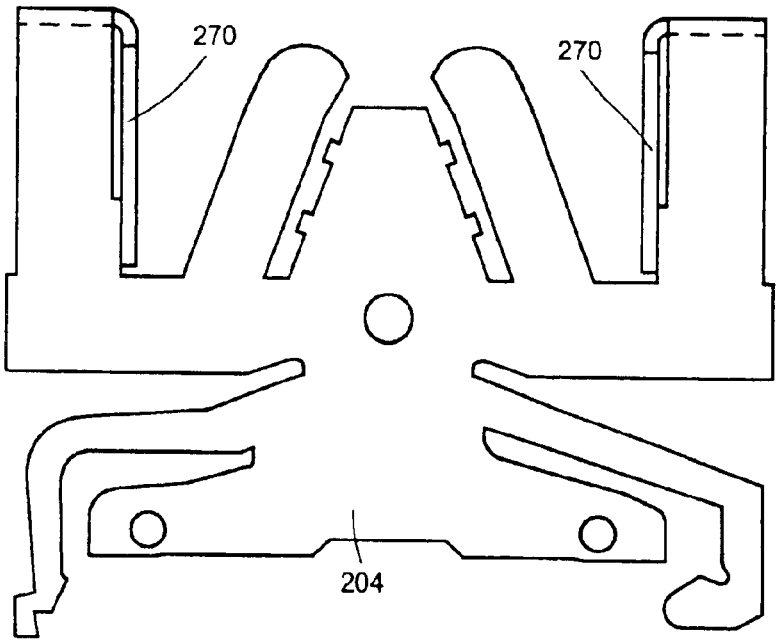
FIGS. 19 and 20 show a side view and an end view, respectively, of a busbar for the embodiment shown in FIGS. 17 and 18.
Figure 20:
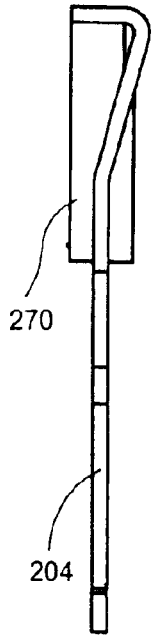
Figure 21:
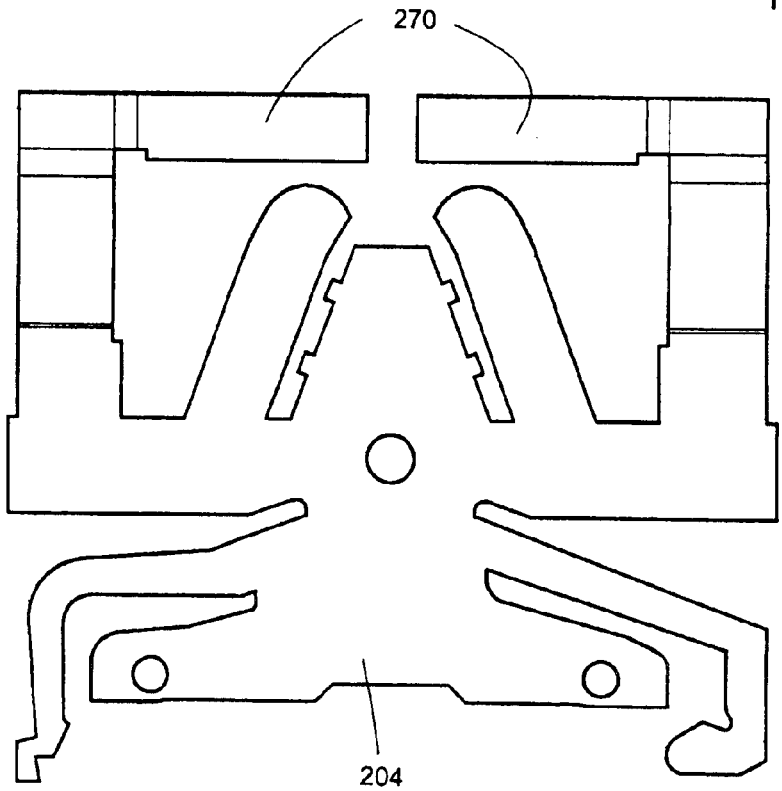
FIG. 21 is a sheet metal blank for producing the busbar shown in FIGS. 19 and 20.

FIGS. 19 to 21 explain the design and production of the busbar 204, which is produced from a single stamped sheet metal blank (FIG. 21) in a few simple bending steps. A protective conductor connection 238 can be provided without considerable extra complexity.

A critical advantage of all of the embodiments of the present invention is that the width of the connecting terminal or terminal strip (dimension in the direction of arrangement 2) is no greater than the width b of the flat or spring element, with the result that a maximum spring force is achieved with a minimum width of the connecting terminal.

What is claimed is:

1. A connecting terminal, comprising:

a busbar;

at least one spring terminal element formed separately of said busbar and electrically conductively connected to said busbar;

said spring terminal element having a spring limb and a contact limb opposite said spring limb for connecting an electrical conductor to be inserted between said spring limb and said contact limb and to rest against said contact limb; and said spring limb and said contact limb each being supported against said busbar for absorbing spring forces.

2. The connecting terminal according to claim 1, wherein said spring limb and said contact limb are formed, in one or more parts, thereof from bent, flat material formed substantially only with bending radii lying in a plane defined orthogonally to a width dimension of said flat material, and the width dimension of said spring terminal element corresponds substantially to a width of said flat material.

3. The connecting terminal according to claim 1, wherein said spring terminal element is formed in two parts, and said spring limb is composed of a material having a high modulus of elasticity.

4. The connecting terminal according to claim 3, wherein said spring limb is formed of spring steel.

5. The connecting terminal according to claim 1, wherein said spring terminal element is formed in two parts, and said contact limb is composed of a highly conductive material.

6. The connecting terminal according to claim 5, wherein said spring limb is formed of a copper alloy.

7. The connecting terminal according to claim 1, wherein said spring limb and said contact limb are substantially U-shaped or V-shaped and said spring limb and said contact limb are connected to one another along in each case one subregion.

8. The connecting terminal according to claim 1, wherein said contact limb is formed with fluting for improving a contact with and fixing of the conductor.

9. The connecting terminal according to claim 1, wherein said busbar is formed with a projection and said contact limb is formed with a slot opening for connecting to said projection on said busbar.

10. The connecting terminal according to claim 9, wherein slot opening is configured for riveting or clamping with said projection on said busbar.

11. The connecting terminal according to claim 1, wherein said spring limb and said contact limb are connected to one another by riveting or by welding.

12. The connecting terminal according to claim 1, wherein said spring terminal element has an additional spring section adapted to exert an additional spring force on the spring limb when a deflection thereof exceeds a predetermined amount.

13. The connecting terminal according to claim 1, wherein said busbar is formed from a planar, flat material and oriented perpendicular to a width dimension of said spring terminal element.

14. The connecting terminal according to claim 13, wherein said busbar is a stamped part formed from a planar, flat material.

15. The connecting terminal according to claim 14, wherein said support attachments extend inclined with respect to said busbar for improving a supporting effect thereof.

16. The connecting terminal according to claim 13, wherein said busbar is formed with at least one accommodating recess for receiving said at least one spring terminal element.

17. The connecting terminal according to claim 16, wherein said accommodating recess is U-shaped with a base section and two side sections, and said spring terminal element is fixed to said base section, in particular by riveting, clamping or welding.

18. The connecting terminal according to claim 17, wherein said base section of said accommodating recess is formed with a projection engaging in a slot opening formed in said spring terminal element.

19. The connecting terminal according to claim 13, wherein said busbar includes spring contacts for accommodating at least one link finger.

20. The connecting terminal according to claim 19, wherein said spring contacts and said busbar are an integrally formed stamped part.

21. The connecting terminal according to claim 13, wherein a protective conductor connection is formed integrally with the busbar.

22. The connecting terminal according to claim 1, wherein said busbar is formed from a strip of a planar, flat material having a width substantially corresponding to a width of said spring terminal element.

23. The connecting terminal according to claim 22, wherein said spring terminal element is formed with support attachments bracing against said busbar.

24. The connecting terminal according to claim 23, wherein said contact limb is U-shaped in a central region and merges at both end sections with reversely U-shaped support attachments, and wherein free ends of said support attachments are connected to said busbar.

25. The connecting terminal according to claim 24, wherein said free ends of said support attachments are riveted or latched to said busbar.

26. The connecting terminal according to claim 24, wherein said free ends of said support attachments engage in a resilient manner in stamped openings formed in said busbar.

27. The connecting terminal according to claim 1, wherein said busbar is substantially planar.

28. The connecting terminal according to claim 1 formed as a terminal strip.

29. A connecting terminal, comprising:

a busbar produced from a planar, flat material;

at least one spring terminal element formed separately from said busbar, retained on said busbar;

said spring terminal element having a spring limb for connecting an electrical conductor;

said spring terminal element being formed from a bent spring material strip of a given width and having substantially only bending radii lying in a plane oriented perpendicular to a width direction thereof, such that a width dimension of said spring terminal element substantially corresponds to said given width of said spring material; and wherein said busbar is oriented perpendicular to the width direction of said spring terminal element and said spring terminal element is supported against the busbar for absorbing spring forces.

30. The connecting terminal according to claim 29, wherein a contact face, against which said spring limb of said spring terminal element presses an electrical conductor, is formed by a region of said planar, flat material, angled perpendicularly to a plane of extent of said busbar.

31. The connecting terminal according to claim 30, wherein said spring terminal element and said busbar are interconnected by riveting or welding.

32. The connecting terminal according to claim 29, wherein said busbar has a stop, formed integrally therewith, against which the spring limb rests to an increasing extent as a deflection thereof increases.

33. The connecting terminal according to claim 29, wherein said busbar is formed with an accommodating recess for receiving said spring terminal element.

34. The connecting terminal according to claim 29, which further comprises a protective conductor connection formed integrally with said busbar.

35. The connecting terminal according to claim 29 formed as a terminal strip.

* * * * *